United States Patent [19]

Mollinger

[11] 3,950,906

[45] Apr. 20, 1976

[54] FLEXIBLE CURTAIN WALL

[76] Inventor: Sebastian Mollinger, P.O. Box 127, Roxboro 9003 Quebec, Canada

[22] Filed: Mar. 26, 1974

[21] Appl. No.: 454,955

[52] U.S. Cl. ..... 52/235; 52/222; 52/83; 52/622

[51] Int. Cl.[2] ..... E04H 1/00

[58] Field of Search ..... 52/2, 83, 235, 222, 52/309, 71, 715, 722, 726

[56] References Cited

UNITED STATES PATENTS

| | | | |
|---|---|---|---|
| 2,731,927 | 1/1956 | McCain | 52/83 |
| 3,118,186 | 1/1964 | Moss | 52/71 |
| 3,762,108 | 10/1973 | Pierson | 52/83 X |
| 3,762,110 | 10/1973 | Boss, Jr. | 52/222 X |

*Primary Examiner*—Frank L. Abbott
*Assistant Examiner*—Carl D. Friedman

[57] ABSTRACT

A moderately flexible, daylight transmitting and insulated curtain wall that lends itself to industrialized mass-production, is delivered to the site in a large roll and connected on minor attachments to building columns. Curtain walls consist of corrugated or flat metal sheet with large percentage of openings which are covered by transparent plastic film or sheet on outside and inside, spaced apart by strips of insulating foam. Major structural elements are wire ropes which are embedded in the corrugations of the sheet metal or merely mechanically attached and fastened to the inside of non-corrugated sheet metal.

6 Claims, 5 Drawing Figures

FLEXIBLE CURTAIN WALL

BACKGROUND OF THE INVENTION a. Field of the Invention

The present inventon relates to a new way of fabricating and erecting a curtain wall.

b. Description of the Prior Art

Present practice for curtain walls is to use rigid secondary structural elements which are rigidly connected to either the main vertical structural elements i.e. columns, or to floor slabs or spandrel beams of a building. Present practice for curtain walls with windows is to use rigid window frames and rigid window panes and to assemble such curtain walls on site.

With the arrival of strong, weather-resistant, flexible and transparent plastic films and sheets a new approach to curtain walls — as is the subject of the present invention is now possible.

SUMMARY OF THE INVENTION

An object of the present invention is to prefabricate curtain walls in the shop in industrialized mass-production. Another object is to roll up the prefabricated curtain wall and transport it to the site in the form of a very large roll, possibly 30 feet long and as large a diameter as transport limitations would allow. A further object is to simplify the connection of the curtain wall to the columns of buildings.

From a broad aspect, the present invention provides a flexible, daylight transmitting and insulated curtain wall having wire ropes as its main structural elements.

BRIEF DESCRIPTION OF THE DRAWINGS

Having thus generally described the nature of the invention reference is made to the accompanying drawings showing by way of an example specific embodiments thereof and in which.

DESCRIPTION OF PREFERRED EMBODIMENTS

Figure 1:
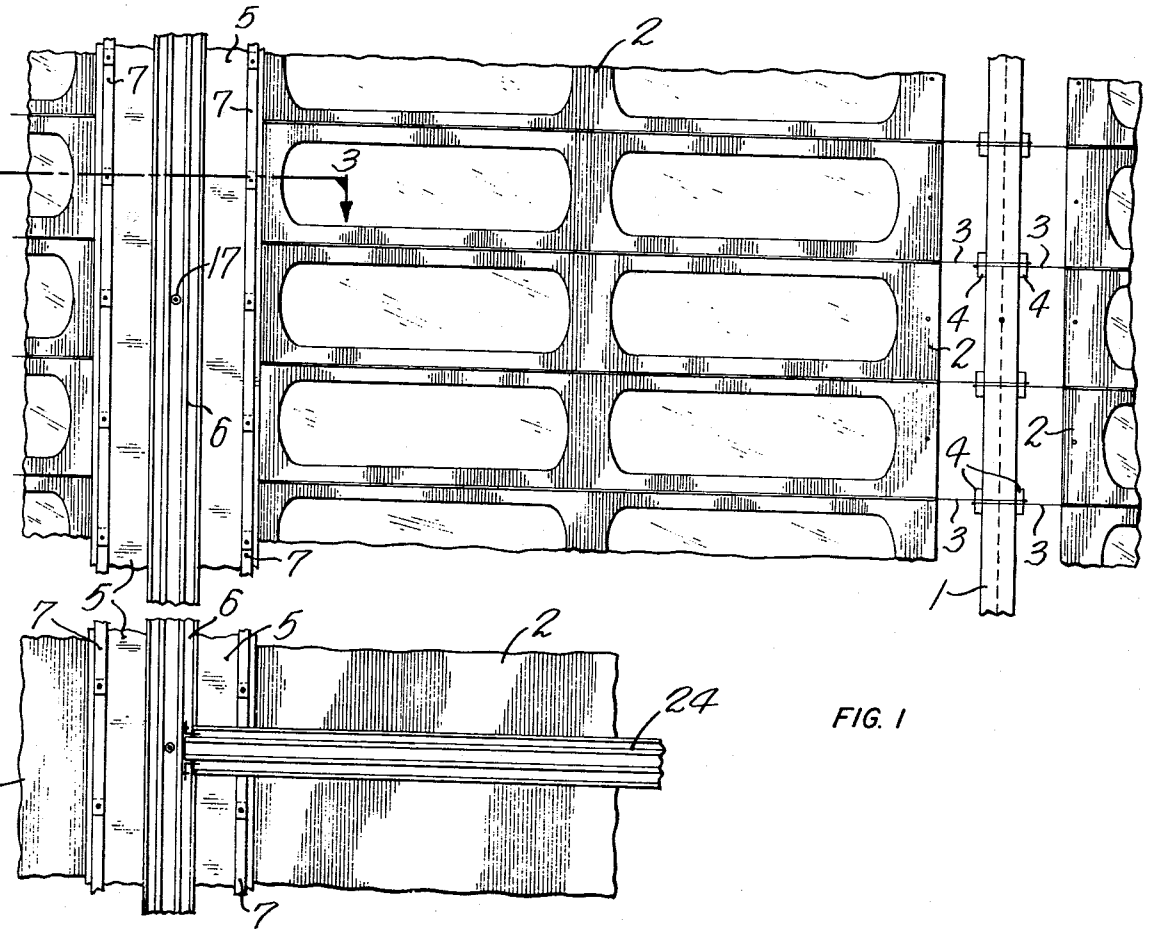
FIG. 1 is an elevation of curtain wall as seen from the outside of a building with closure sandwich and column fascia removed on right hand column.
Figure 2:
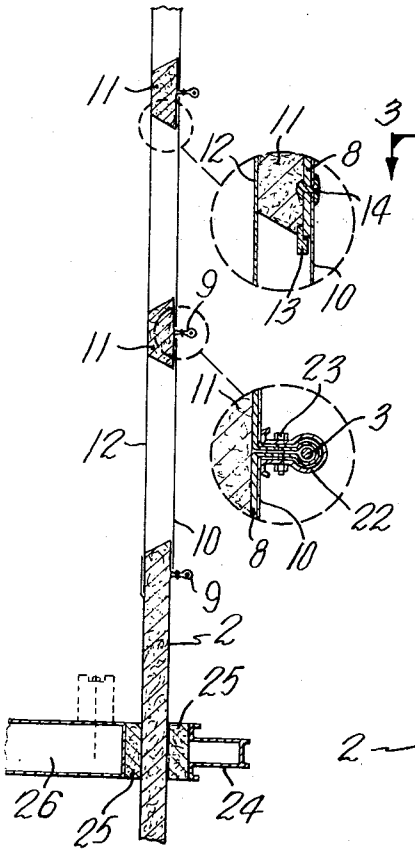
FIG. 2 is a vertical sectional view through a portion of the curtain wall and floor.
Figure 3:
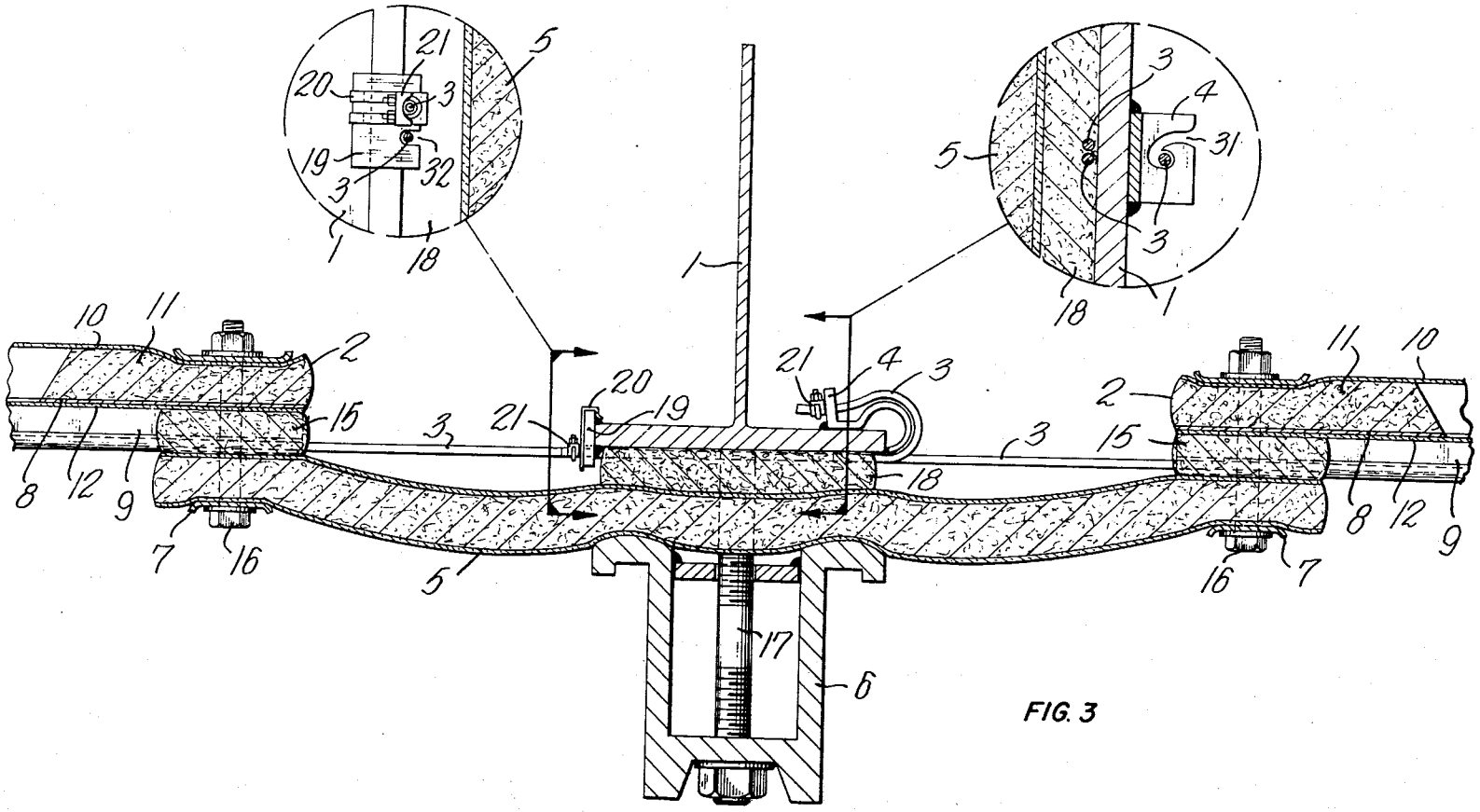
FIG. 3 is a horizontal section at building column with alternative methods of connecting wire ropes to columns.
Figure 4:
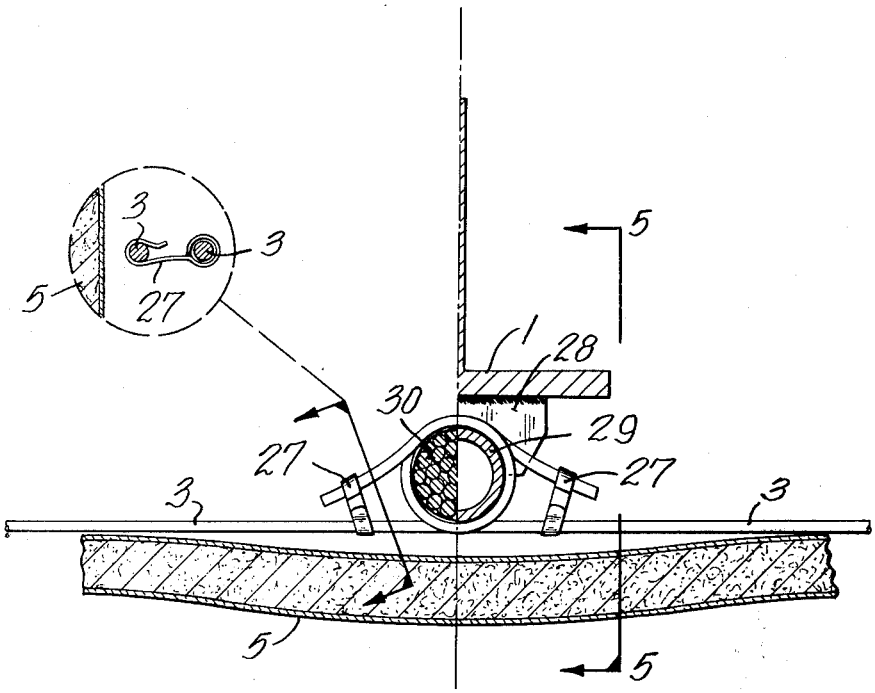
FIG. 4 is a horizontal section showing one further alternative method of connecting wire ropes to columns and one method of connecting wire ropes to a pipe or to a cable.
Figure 5:
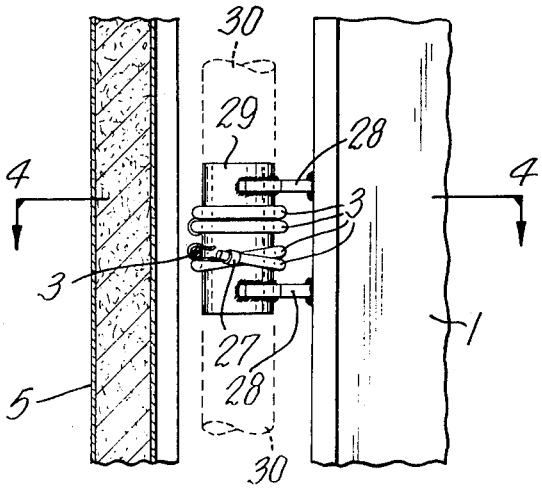
FIG. 5 is a sectional view along section lines 5—5 of FIG. 1.

Reference Characters:

| | | | |
|---|---|---|---|
| 1. | building column | 17. | steel bolt stud |
| 2. | curtain wall | 18. | foam slab strip |
| 3. | wire ropes | 19. | flat steel plate |
| 4. | attachment to columns | 20. | metal clip |
| 5. | flexible closure sandwich | 21. | wire rope clip |
| 6. | column fascia | 22. | Omega-shaped stainless steel spring |
| 7. | stainless steel leaf springs | 23. | stainless steel bolt & nut |
| 8. | sheet metal with openings for daylight transmission | 24. | floor fascia |
| | | 25. | foam slab strips |
| 9. | corrugations | 26. | floor slab |
| 10. | exterior transparent plastic film or sheet | 27. | wire rope clip with friction hook |
| 11. | foam strips | 28. | steel plate |
| 12. | interior transparent plastic film or sheet | 29. | pipe |
| 13. | shear strip | 30. | cable |
| 14. | plastic rivets | 31. | friction slot |
| 15. | foam slab filler | 32. | U - slot |
| 16. | plastic bolts | | |

Referring to the drawings, curtain wall 2 is a sandwich-like assembly of four layers consisting from inside to outside of an interior transparent plastic film or sheet 12, spaced apart foam strips 11, sheet metal with openings for daylight transmission 8 and exterior transparent plastic film or sheet 10.

Major structural elements of the curtain wall are wire ropes 3 spanning and forming a catenary under wind loads between columns 1. In order to reduce movements and vibration of the flexible curtain wall 2 under wind conditions, corrugations 9 are arranged where wire ropes 3 are to be located. Corrugations 9 of sheet metal 8 take the form of a closed V but with wire ropes 3 embedded in the root of the V and sheet metal 8 wrapped tightly around wire ropes thus obtaining a miniature beam with a web of two parallel and touching legs of sheet metal 8, one flange of two angles of sheet metal and the other flange having wire rope 3 as a core with sheet metal wrapped around it. In the case of wind pressure acting on the curtain wall from the outside wire ropes 3 are being put in compression provided that there is a continuous and effective contact between rope and wrapped around sheet metal — an interesting and certainly different and novel structural use of wire ropes.

Exterior transparent material 10, if a film, can be wrapped around corrugation 9 and clamped to it by an omega-shaped stainless steel spring 22. Continuous spring 22 acts as an additional stiffening member of the curtain wall and is attached at certain intervals to the web of corrugations 9 by stainless steel bolts 23. If this wrap-around alternative is not used there is the alternative of bonding the exterior film or sheet 10 to sheet metal 8 and ensure its effectiveness by the use of shear strips 13 which are bonded to exterior film or sheet 10 and/or the use of plastic rivets 14.

Foam strips 11 bonded to sheet metal 8 and interior film 12 will provide insulation in themselves and will act as spacers between sheet metal 8 and interior film 12 and thus creating enclosed air spaces where daylight transmission is to occur. Of course, the enclosed air is the most effective insulation material.

When the physical properties of plastics and their fabrication and assembly techniques will be a little further advanced it will be possible to omit sheet metal 8 altogether thus further simplifying the assembly of such curtain walls. The exterior plastic sheet 10 will then also assume the structural and economic functions of sheet metal 8.

Wire ropes 3 will extend beyond the sides of curtain wall 2 and will be provided with wire rope clips 21 or wire rope clips with friction hook 27 at their ends for their connection to the main structural elements. Foam slab fillers 15 will be bonded between corrugations 9 along the ends of the curtain wall.

With a not very complex laminating and assembly machine and a labour force of only 8 to 10 people it will be possible to assemble 100,000 square feet of a thus far described, moderately flexible, insulated and daylight transmitting curtain wall. The finished product will be rolled up on a 36 inch diameter steel pipe core and stored or transported to the site in this form of a very large roll.

On site the open end of the rolled up curtain wall will be attached first to either the top and unrolled downwards or to the bottom and unrolled upwards by a hoist which lifts and unrolls the giant roll by its steel pipe core. The ends of wire ropes 3 are then connected to the main structural elements. In the case where the main structural element is a column 1 it will be necessary to provide minor attachments unless direct welding of wire ropes to columns is considered economically and structurally feasible.

Each of the three alternatives of minor attachments to columns illustrated and described herein have the advantage that they consist of a minor weldment that can be attached to the columns in the shop and that the attachment of wire ropes 3 in the field consists merely in the snapping in of wirie ropes 3 or of a metal clip 20 or of the winding around and hooking on of wire rope clip with friction hook 27 thus eliminating field welding, bolting or riveting in the attachment of curtain walls.

Alternative one of a minor attachment of columns for the structural connection of wire ropes 3 to column 1 has the form of a somewhat open five 4 with a friction slot 31 in its offstanding leg. Minor attachment 4 is shopwelded to column 1 at pre-determined locations and may be made from an angle with unequal legs or a steel plate so deformed as to give a minimum radius bend for the respective diameter of wire rope 3. The free end of wire rope 3 is pushed into friction slot 31 and shop-attached wire rope clips 21 will act as anchor.

Unless disconnected by man this connection will not otherwise become undone as the tendency of wire rope 3 to straighten out will keep it in the position at the end of friction slot 31 which has the form of a reversed J. In addition the width of friction slot 31 will be such as to provide more than sufficient friction to prevent wire rope 3 from leaving the slot.

Alternative two of a minor attachment to columns for the structural connection of wire ropes 3 to columns 1 consists merely of a flat steel plate 19 having two adjacent U-slots 32 on one side. Flat steel plates 19 are shopwelded to column 1 at predetermined locations and the field connection consists merely of the insertion of the loose ends of wire ropes 3 into U-slots 32 so that the shop-attached wire rope clips 21 act as anchors and the snapping on of metal clips 20. Metal clips 20 will prevent wire ropes 3 from leaving U-slots 32.

Alternative three of a minor attachment to columns for the structural connection of wire ropes 3 columns 1 consists of two steel plates 28, so shaped as to receive a short piece of a pipe 29. Steel plates 28 and pipe 29 are welded together and this assembly is then shopwelded at predetermined locations to columns. When this type of attachment to columns is used the free ends of wire ropes 3 will have wire rope clips with friction hook 27 shop-attached to their ends and the field connection consists merely in winding the free end of wire ropes substantially 1.7 times around the pipe and hooking it onto itself with friction hook 27. This connection is also applicable if made to a cable 30 and it will not disconnect itself under the severest of loading.

In order to permit the structural attachment of curtain walls 2 to columns 1 or to cables 30 to be made from the outside or from the inside of a building and about a 12 inch gap is left between the vertical ends of the curtain walls on either side of columns 1 or cables 30. These gaps will be closed by a flexible closure sandwich 5 consisting of three layers. A flexible exterior layer made of a tough, weather-resistant and good looking plastic material, a core made of flexible urethane or other foam and an interior layer made of a flexible plastic material, possibly the same as the exterior layer.

Curtain walls 2 and flexible closure sandwich 5 will have matching pre-punched holes along their sides and will be bolted together in the field using plastic bolts 16. In order to ensure weathertightness and for appearance reasons stainless steel leaf springs 7 are to be used on the outside so as to compress the joints between leaf springs 7 and sheet metal 8. Only large washers are needed on the inside. The use of bonding agents on joints may be feasible and may make the use of bolts, leaf springs and washers obsolete.

Column fascia 6 is for a double purpose i.e., for appearance reasons and also used to provide a continuous member that compresses a continuous foam slab strip 18 on the face of the column thus creating a sound barrier should the column be on a room dividing line. Foam slab strip 18 also acts as a spacer to prevent damage to the inside of flexible closure sandwich 5. For the same reasons are foam slab strips 25 and floor fascia 24 used where there are floors extending to the curtain wall.

Those parts of foam slab strips 25 and foam slab fillers 15 that are exposed to the weather should either be made of self-skinned, weather-resistant foams or be covered by weather resistant flexible plastic skin.

I claim:

1. A flexible, daylight transmitting and insulated curtain wall having the shape of an elongated rectangular sandwich, one layer of said sandwich consisting of a perforated sheet metal and having a set of spaced apart wire ropes extending parallel across its width, said wire ropes extending on either side beyond the width of said perforated sheet metal and connected to said sheet metal, said wire ropes constituting the main load carrying elements in said curtain wall.

2. A curtain wall as defined in claim 1, further comprising:

a flexible, translucent or transparent interior skin, a core of flexible, insulating and spaced apart foam strips, said foam strips being located between said interior skin and said perforated sheet metal and omitted from areas where daylight transmission is to take place, a flexible, translucent or transparent and weather resistant exterior film or sheet, said sheet metal having perforations or openings where daylight transmission is to take place, all bonded together to form said curtain wall.

3. A curtain wall as claimed in claim 2 wherein said wire ropes are placed between said core of foam strips and said sheet metal and being mechanically attached to said sheet metal.

4. A curtain wall as defined in claim 2, wherein said sheet metal is provided with corrugations extending across its width, the corrugations being of omega-shape cross-section and wherein said wire ropes are embedded in a round part formed by said corrugations.

5. A curtain wall as defined in claim 4 wherein said exterior film is wrapped around the outside of said corrugations and clamped to the web of said corrugations by an omega-shaped stainless steel spring and bolted together at their common web.

6. A curtain wall as defined in claim 1 wherein a gap is formed between adjacent curtain walls, said gap being closed by a flexible sandwich consisting of two or more layers of flexible plastic materials bonded together and having the shape of an elongated narrow strip, the long side edges of said flexible sandwich overlapping the long side edges of said adjacent curtain walls and made weathertight by the use of a continuous series of leaf springs and bolts clamping the overlapping edges of said curtain walls and said flexible sandwich together.

* * * * *